US008624786B2

(12) United States Patent
Saito

(10) Patent No.: US 8,624,786 B2
(45) Date of Patent: Jan. 7, 2014

(54) ANTENNA, ADJUSTMENT METHOD THEREOF, AND ELECTRONIC DEVICE IN WHICH THE ANTENNA IS IMPLEMENTED

(75) Inventor: Katsuo Saito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 221 days.

(21) Appl. No.: 13/309,981

(22) Filed: Dec. 2, 2011

(65) Prior Publication Data

US 2012/0139803 A1 Jun. 7, 2012

(30) Foreign Application Priority Data

Dec. 7, 2010 (JP) ..... 2010-273018
Oct. 3, 2011 (JP) ..... 2011-219566

(51) Int. Cl.
*H01Q 1/24* (2006.01)

(52) U.S. Cl.
USPC ..... 343/702; 343/846

(58) Field of Classification Search
USPC ..... 343/702, 846
See application file for complete search history.

(56) References Cited

U.S. PATENT DOCUMENTS 5,483,249 A 1/1996 Kennedy
6,600,448 B2 7/2003 Ikegaya et al.
7,026,999 B2 * 4/2006 Umehara et al. ..... 343/702
7,755,545 B2 * 7/2010 Takei et al. ..... 343/702
7,777,682 B2 * 8/2010 Yagi ..... 343/725
7,796,086 B2 * 9/2010 Coskun et al. ..... 343/7 MS
2008/0204346 A1 8/2008 Tawata

FOREIGN PATENT DOCUMENTS

JP 07-193419 A 7/1995
JP 09-162642 A 6/1997

* cited by examiner

*Primary Examiner* — Hoang V Nguyen
(74) *Attorney, Agent, or Firm* — Carter, DeLuca, Farrell & Schmidt LLP

(57) ABSTRACT

An antenna used in wireless communication, comprises: a dielectric substrate; a ground conductor portion arranged upon the dielectric substrate; an antenna element including a radiating conductor portion arranged upon the dielectric substrate opposite to the ground conductor portion, a shorted conductor portion that connects the radiating conductor portion and the ground conductor portion, and a power supply unit adapted to supply a high-frequency current to the radiating conductor portion; and an open conductor portion connected at high frequencies to the ground conductor portion, wherein the open conductor portion is connected to the dielectric substrate so as to protrude by a predetermined length from the location of the ground conductor portion in a diagonal direction from the location where the ground conductor portion and the shorted conductor portion are connected.

11 Claims, 15 Drawing Sheets

ANTENNA, ADJUSTMENT METHOD THEREOF, AND ELECTRONIC DEVICE IN WHICH THE ANTENNA IS IMPLEMENTED

BACKGROUND OF THE INVENTION

1. Field of the Invention

The present invention relates to antennae used in wireless communication, adjustment methods for such antennae, and electronic devices in which such antennae are implemented.

2. Description of the Related Art

In recent years, electronic devices such as personal computers that are provided with wireless communication functionality, such as wireless LAN or Bluetooth®, are becoming widespread. Wireless communication over wireless LAN, Bluetooth, and so on is carried out using radio waves in, for example, the 2.5 GHz band, the 5 GHz band, or the like. A personal computer provided with such wireless communication functionality integrates an antenna for wireless communication; various types of antennae are used depending on the model of the computer, such as a dipole antenna, a helical antenna, a slot antenna, an inverted-F antenna, and so on.

Due to reductions in the sizes of electronic devices, it is becoming necessary to implement these various types of antennae in areas having limited amounts of space, and there is also a demand for reductions in the costs thereof. As a result, attempts are being made to reduce costs by implementing antennae as patterned shapes upon the boards of wireless module chips, rather than implementing the antennae separately.

However, in the case where an antenna is implemented in an electronic device such as a personal computer, the frequency characteristics of the antenna change depending on the components that are located in the periphery of the antenna. There is thus a problem in that the frequency characteristics obtained when the antenna is in a standalone state differ from the frequency characteristics obtained when the antenna is implemented. Thus far, configurations have been such that changes in the frequency characteristics of an antenna occurring due to the antenna being implemented in an electronic device are absorbed by the antenna. For example, desired frequency characteristics are achieved for an antenna when the antenna is implemented by using various methods, such as adjusting the shape of the antenna.

U.S. Pat. No. 5,483,249 discloses a technique for adjusting a resonation frequency by changing the position of a through-hole in order to adjust the length of the short stub portion of a radiating element that functions as a cavity resonator. The adjustment of the resonation frequency is carried out by changing the length of the stub that configures part of the radiating element.

Japanese Patent Laid-Open No. 09-162642 discloses a technique for adjusting a resonation frequency, in which multiple stubs having free ends are formed connected to a microstrip line-type resonator in advance, and are shorted through soldering in a state in which opening patterns are formed in the vicinities of the ends of the stubs; the resonating frequency is then adjusted by changing the capacities of the stubs connected to the resonator. Likewise, the adjustment of the resonation frequency is carried out by changing the length of the stub that configures part of the radiating element.

However, with the stated past methods of bringing a change in the frequency characteristics of an antenna, occurring when the antenna is implemented, in line with desired characteristics by adjusting the shape of the antenna, the environment in which the antenna is implemented differs depending on the type of electronic device, and thus the change in frequency characteristics occurring when the antenna is implemented is not always the same. There is thus a problem in that the same antenna cannot be used in different types of electronic devices.

The present invention provides a technique for enabling the same antenna to be used in different types of electronic devices while improving the reflection characteristics when the antenna is implemented.

SUMMARY OF THE INVENTION

According to one aspect of the present invention, there is provided an antenna used in wireless communication, comprising: a dielectric substrate; a ground conductor portion arranged upon the dielectric substrate; an antenna element including a radiating conductor portion arranged upon the dielectric substrate opposite to the ground conductor portion, a shorted conductor portion that connects the radiating conductor portion and the ground conductor portion, and a power supply unit adapted to supply a high-frequency current to the radiating conductor portion; and an open conductor portion connected at high frequencies to the ground conductor portion, wherein the open conductor portion is connected to the dielectric substrate so as to protrude by a predetermined length from the location of the ground conductor portion in a diagonal direction from the location where the ground conductor portion and the shorted conductor portion are connected.

According to one aspect of the present invention, there is provided an adjustment method for an antenna used in wireless communication, the antenna including: a ground conductor portion arranged upon a dielectric substrate; an antenna element including a radiating conductor portion arranged upon the dielectric substrate opposite to the ground conductor portion, a shorted conductor portion that connects the radiating conductor portion and the ground conductor portion, and a power supply unit adapted to supply a high-frequency current to the radiating conductor portion; and an open conductor portion connected at high frequencies to the ground conductor portion, and the adjustment method comprising: adjusting an input reflectance coefficient of the antenna element by changing a predetermined length by which the open conductor portion protrudes from the location of the ground conductor portion in a diagonal direction from the location where the ground conductor portion and the shorted conductor portion are connected in accordance with the length of the ground conductor portion in the direction in which the shorted conductor portion faces the ground conductor portion.

Further features of the present invention will be apparent from the following description of exemplary embodiments with reference to the attached drawings.

DESCRIPTION OF THE EMBODIMENTS

Exemplary embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

(First Embodiment)

Figure 1:
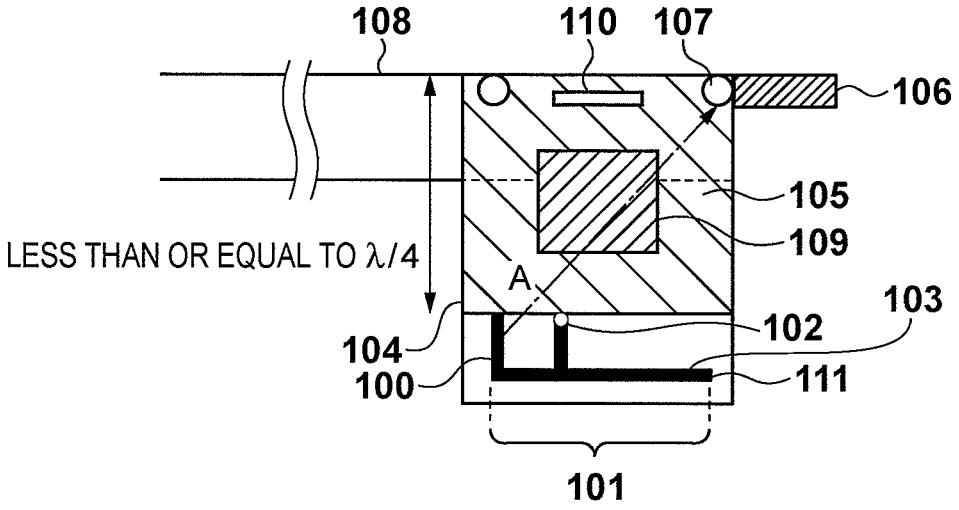
FIG. 1 is a diagram illustrating the basic configuration of an antenna according to the present invention.

FIG. 1 illustrates the basic configuration of an antenna according to the present invention. The antenna includes an antenna element 101, a dielectric substrate 104, a ground conductor portion 105, an open conductor portion 106, an attachment hole 107, a wireless module chip 109, and a connector 110. The antenna element 101, the ground conductor portion 105, the open conductor portion 106, the attachment hole 107, the wireless module chip 109, and the connector 110 are formed upon the dielectric substrate 104. A metal housing sheet 108 is a sheet of metal serving as the main body of an electronic device, not shown, to which the dielectric substrate 104 is attached.

The antenna element 101 is a typical inverted-F antenna, and includes a shorted conductor portion 100, a power supply point 102, and a radiating conductor portion 103. The shorted conductor portion 100 connects the radiating conductor portion 103 and the ground conductor portion 105. The power supply point 102 is a power supply unit that supplies a high-frequency signal (a high-frequency current) to the antenna element 101 at a single point. The radiating conductor portion 103 is arranged opposite to the ground conductor portion 105 with a space provided therebetween. This space may be constant, and in such a case the radiating conductor portion 103 and the ground conductor portion 105 are arranged parallel to each other. Meanwhile, the end that is opposite to the point where the radiating conductor portion 103 and the shorted conductor portion 100 are connected is an open end 111 that is open at high frequencies to the power supply point 102. The dielectric substrate 104 is a board for implementing the antenna element 101, and electronic components such as integrated chips and the like are provided thereupon in addition to the aforementioned constituent elements. The ground conductor portion 105 has an electric length that is less than or equal to ¼ the wavelength of a usage frequency. The ground conductor portion 105 is formed upon the dielectric substrate as a conductive pattern, as a plate-shaped metal sheet, or the like. In the example shown in FIG. 1, the ground conductor portion 105 has a rectangular shape, but the shape does not necessarily need to be a rectangle. The open conductor portion 106 is a characteristic portion of the present invention, and is connected at high frequencies to the ground conductor portion 105 at a predetermined connection location.

The attachment position of the open conductor portion 106 is, when viewed from the shorted conductor portion 100 provided in the antenna element 101, a position that is in the diagonal direction of the ground conductor portion 105 (an end portion position), as indicated by the broken-line arrow A. Grounding is carried out through the attachment hole 107 using a screw or the like. The connector 110 is a connector for supplying signals to the main body of the electronic device or the wireless module chip 109.

Here, it is generally necessary for the electric length of the ground conductor portion 105 on the dielectric substrate 104 (that is, the length in the direction that opposes the radiating conductor portion 103) to be greater than or equal to $\lambda/4$ in order to cause the antenna element 101 to resonate with a sufficient reflectance coefficient in an operating frequency. Here, $\lambda$ indicates the wavelength of the center frequency in the operating frequency band.

In other words, normally, if an electrical length greater than or equal to $\lambda/4$ cannot be secured for the ground portion 105 on the dielectric substrate 104 on which the antenna element 101 is implemented, sufficient input reflection characteristics cannot be obtained for the antenna element 101.

Figure 2B:
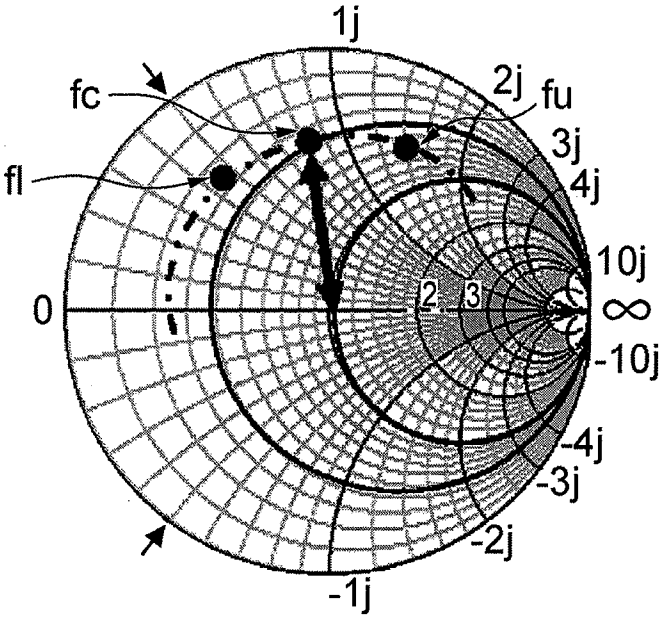
FIGS. 2A and 2B are diagrams illustrating reflectances in the case where the length of a ground portion of an antenna implementing board is short.
Figure 2A:
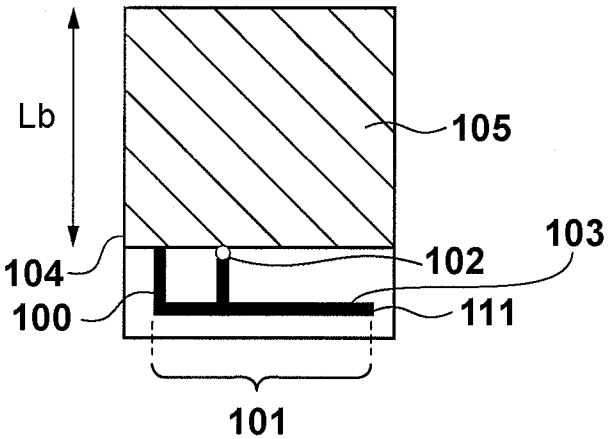

FIGS. 2A and 2B illustrate input reflection characteristics of the antenna element 101 in the case where an electric length of greater than or equal to $\lambda/4$ cannot be ensured for the ground conductor portion 105 upon the dielectric substrate 104. In FIG. 2A, the length of the ground conductor portion 105 on the dielectric substrate 104 is expressed as Lb.

For example, assuming a wireless LAN having a usage frequency band of 2 GHz, and assuming 2.45 GHz for the center frequency of the usage frequency band, $\lambda/4$ is approximately 30 mm. Sufficient reflection characteristics can be attained for the antenna element 101 accordingly, if Lb is a length greater than or equal to 30 mm. However, in the case where, for example, only approximately 18 mm can be ensured for Lb, reflection characteristics as indicated by the two-sided arrow in the Smith chart in FIG. 2B, in which the distance from the center is great, are obtained for the antenna element 101.

VSWR (voltage standing wave ratio) and RL (return loss) exist as indicators of reflection characteristics, and closer distances from the center in the Smith chart indicate better reflection characteristics. A VSWR that is less than 2.0 and a RL less than −9.5 dB are normally required for the reflection characteristics of an antenna. A relationship between the voltage standing wave ratio VSWR and the return loss RL is illustrated hereinafter.

Equation 1

$$VSWR = \frac{10^{RL/20} + 1}{10^{RL/20} - 1} \quad (1)$$

Equation 2

$$RL = 20\log_{10}\left\{\frac{VSWR + 1}{VSWR - 1}\right\} \quad (2)$$

fl, fc, and fu in FIG. 2B indicate the lower end, middle, and upper end frequencies, respectively, of the usage frequency band. RL is typically a value that is greater than or equal to −5 dB, and a voltage standing wave ratio VSWR of less than 2.0 (a return loss RL of less than −9.5 dB), which is normally required for the reflection characteristics of the antenna, cannot be ensured. In order to improve this, it is necessary to change the antenna element pattern, change the matching element, or the like, which eliminates the general applicability of the antenna element, the matching element, and so on. In the present invention, the open conductor portion 106 is configured so that it is not necessary to carry out such changes. The open conductor portion 106 improves the input reflection characteristics of the antenna element 101 in the case where a length Lb of greater than or equal to λ/4 cannot be ensured for the ground conductor portion 105 upon the dielectric substrate 104 on which the antenna element 101 is implemented.

Figure 3A:
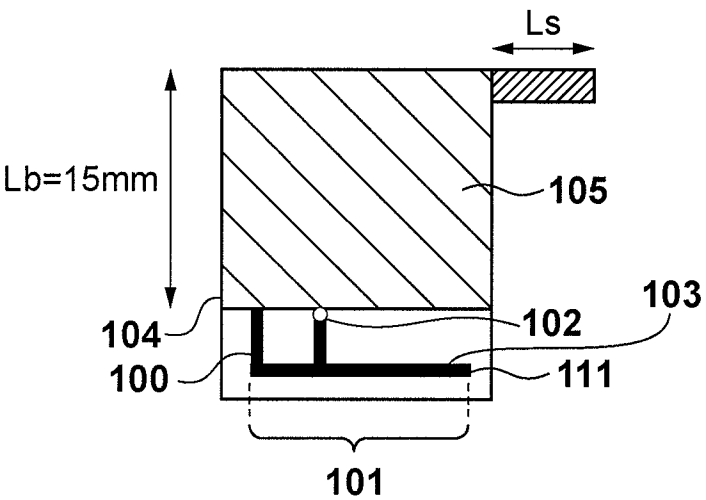
FIGS. 3A and 3B are diagrams illustrating reflection characteristics when a band is 2 GHz, Lb is fixed at 15 mm, and an open conductor length Ls is variable.
Figure 3B:
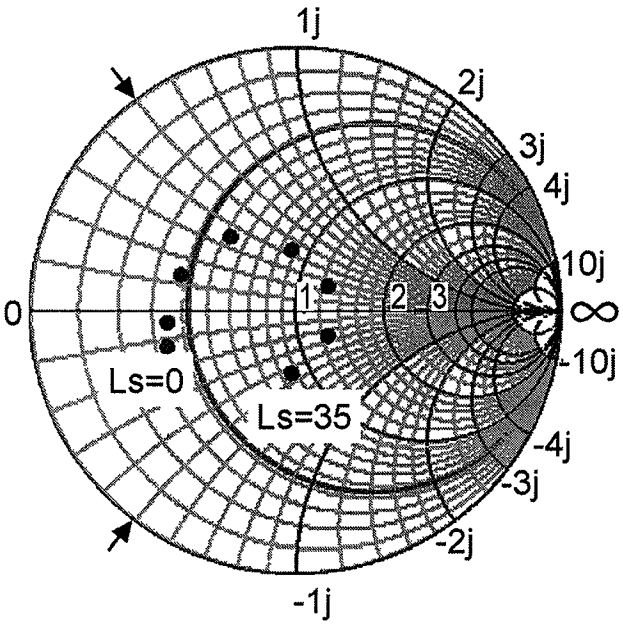

Operations carried out when the open conductor portion 106 is attached to the dielectric substrate 104 will be described with reference to FIGS. 3A and 3B. In FIG. 3A, the length of the ground conductor portion 105 on the dielectric substrate 104 is assumed to be 15 mm, and the length of the open conductor portion 106 is expressed as Ls. FIG. 3B illustrates the input reflection characteristics of the antenna element 101 when the length Ls of the open conductor portion 106 has been changed. FIG. 3B is a Smith chart indicating the values of a reflectance coefficient at various points, assuming that the measurement frequency is the center frequency of 2.44 GHz in a 2 GHz band for a WLAN. The eight points in the Smith chart shown in FIG. 3B are obtained by changing the length Ls at 5 mm intervals from 0 mm to 35 mm. In the case where the length Lb of the ground conductor portion 105 upon the dielectric substrate 104 is 15 mm, and the length Ls of the open conductor portion 106 is 0 mm, or in other words, the open conductor portion 106 is not attached, there is a large reflectance from the input of the antenna element 101, and it is difficult to ensure a VSWR that is less than 2.0. However, it can be seen that adjusting the length Ls of the open conductor portion 106 improves the reflection characteristics. A reflectance coefficient in which the VSWR is less than 2.0 can be obtained by setting the length Ls of the open conductor portion 106 to greater than or equal to approximately 20 mm.

Figure 4A:
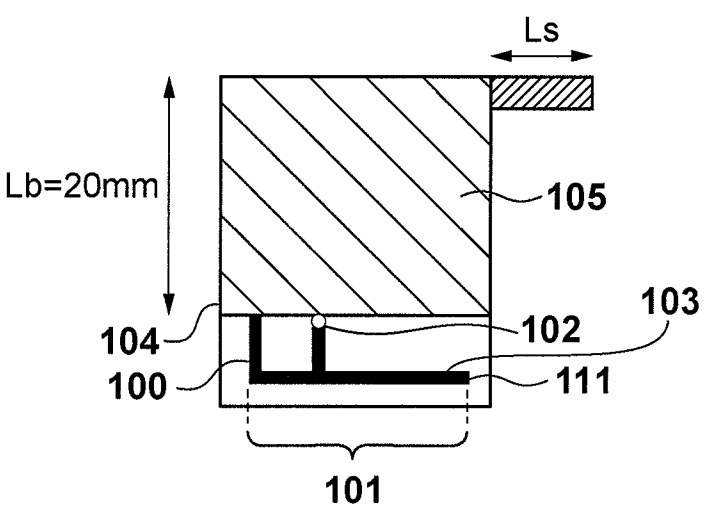
FIGS. 4A and 4B are diagrams illustrating reflection characteristics when a band is 2 GHz, Lb is fixed at 20 mm, and an open conductor length Ls is variable.
Figure 4B:
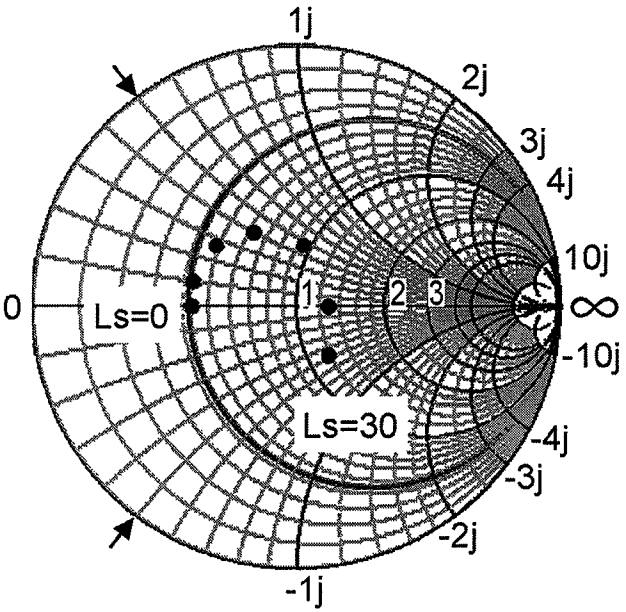

Operations carried out when the open conductor portion 106 is attached to the dielectric substrate 104 will be described with reference to FIGS. 4A and 4B. In FIG. 4A, the length Lb of the ground conductor portion 105 on the dielectric substrate 104 is assumed to be 20 mm. FIG. 4B is a Smith chart illustrating the input reflection characteristics of the antenna element 101 when the length Ls of the open conductor portion 106 has been changed. In the case where the length Lb of the ground conductor portion 105 upon the dielectric substrate 104 is 20 mm, the length of the ground conductor portion 105 is 5 mm longer, and thus a reflectance coefficient in which the VSWR is less than 2.0 can be obtained by setting the length Ls of the open conductor portion 106 to greater than or equal to approximately 15 mm, as opposed to the changes in the reflection characteristics illustrated in FIG. 3B.

Figure 5B:
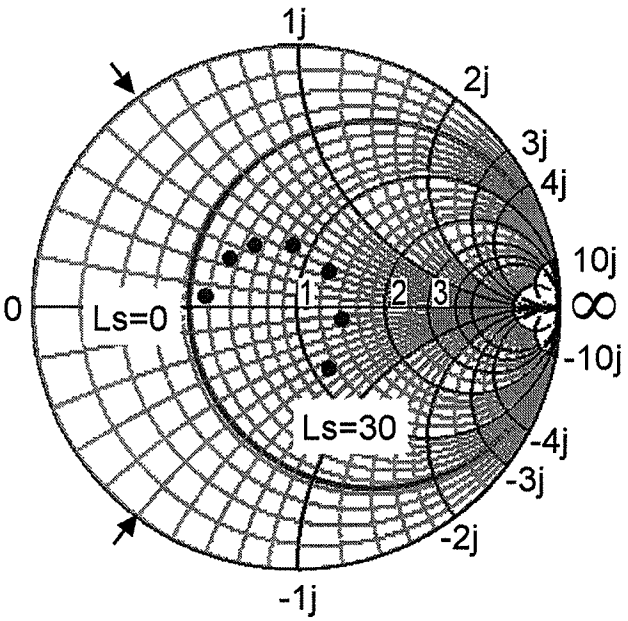
FIGS. 5A and 5B are diagrams illustrating reflection characteristics when a band is 2 GHz, Lb is fixed at 25 mm, and an open conductor length Ls is variable.
Figure 5A:
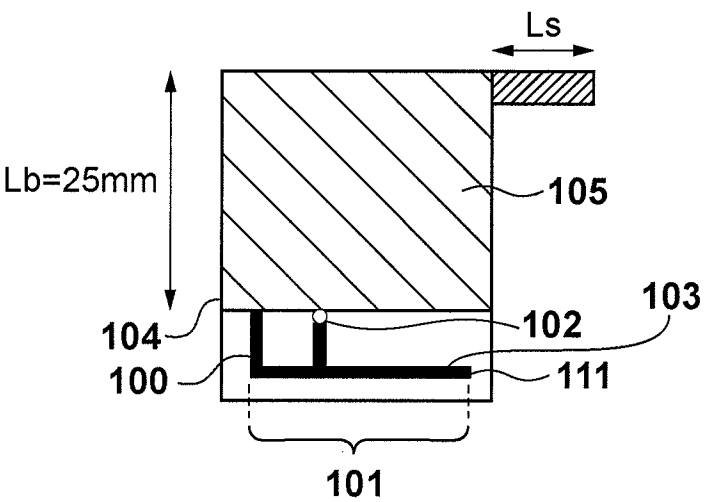

Operations carried out when the open conductor portion 106 is attached to the dielectric substrate 104 will be described with reference to FIGS. 5A and 5B. In FIG. 5A, the length Lb of the ground conductor portion 105 on the dielectric substrate 104 is assumed to be 25 mm. FIG. 5B is a Smith chart illustrating the input reflection characteristics of the antenna element 101 when the length Ls of the open conductor portion 106 has been changed. Because the length of the ground conductor portion 105 is 5 mm longer, a reflectance coefficient in which the VSWR is less than 2.0 can be obtained by setting the length of the open conductor portion 106 to greater than or equal to approximately 10 mm, as opposed to the changes in the reflection characteristics illustrated in FIG. 4B.

As described thus far, the length Ls of the open conductor portion 106 is changed in accordance with the length Lb of the ground conductor portion 105 on the dielectric substrate 104. For example, the length Ls of the open conductor portion 106 is changed in an inverse proportion to the length Lb of the ground conductor portion 105 on the dielectric substrate 104. As a result, when the wavelength of the usage frequency is taken as λ, even in the case where a length of greater than or equal to λ/4 cannot be ensured for the length Lb of the ground conductor portion 105 upon the dielectric substrate 104, adjusting the length of Ls in accordance with the length of Lb makes it possible to improve the input reflection characteristics of the antenna element 101 without changing the pattern of the antenna element 101, changing the matching element, and so on.

Figure 6B:
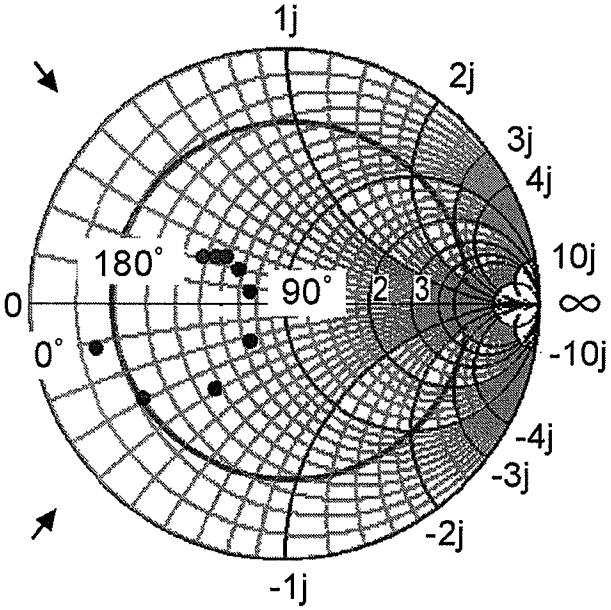
FIGS. 6A and 6B are diagrams illustrating reflection characteristics when a band is 2 GHz and the attachment angle of an open conductor to an antenna implementing board is variable.
Figure 6A:
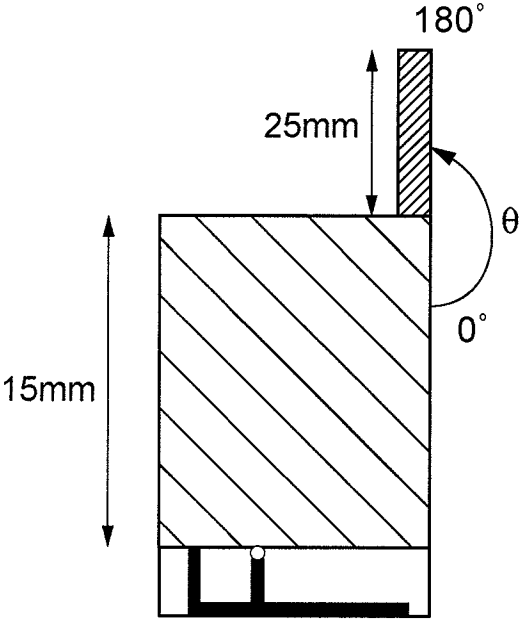

Next, changes in the input reflection characteristics of the antenna element 101 in the case where the attachment angle of the open conductor portion 106 relative to the dielectric substrate 104 has been changed will be described with reference to FIGS. 6A and 6B. In FIG. 6A, the length Lb of the ground conductor portion 105 on the dielectric substrate 104 is assumed to be 15 mm, and the length Ls of the open conductor portion 106 is assumed to be 25 mm. FIG. 6B is a Smith chart illustrating the input reflectance of the antenna element 101 when an attachment angle θ of the open conductor portion 106 relative to the side surface of the dielectric substrate 104 has been changed from 0° to 180°. FIG. 6B indicates the values of a reflectance coefficient at various points, assuming that the measurement frequency is the center frequency of 2.44 GHz in a 2 GHz band for a WLAN. Meanwhile, Table 1 illustrates values in which the return loss RL of the antenna element 101 at each of the angles θ is expressed in units of dB.

TABLE 1

| θ | RL(dB) |
|---|---|
| 0 | −7.0 |
| 15 | −8.0 |
| 30 | −10 |
| 45 | −16 |
| 60 | −18 |
| 90 | −25 |
| 120 | <−10 |
| 135 | <−10 |
| 180 | <−10 |

In FIG. 6B, it can be seen that when the angle θ is 0°, the open conductor portion 106 overlaps with the ground conductor portion 105, and the state is equivalent to a state in which the open conductor portion 106 is not present. In this case, there is a high reflectance from the input end of the antenna element 101, resulting in an RL of −7.0 dB; it is thus not possible to ensure conditions in which the VSWR is less than 2.0 (the RL is less than −9.5 dB). However, it can be seen that the reflection characteristics are improved by increasing the angle θ. From Table 1, it can be seen that conditions in which the VSWR is less than 2.0 (the RL is less than −9.5 dB) can be ensured if the angle θ is greater than or equal to 30°.

Figure 7:
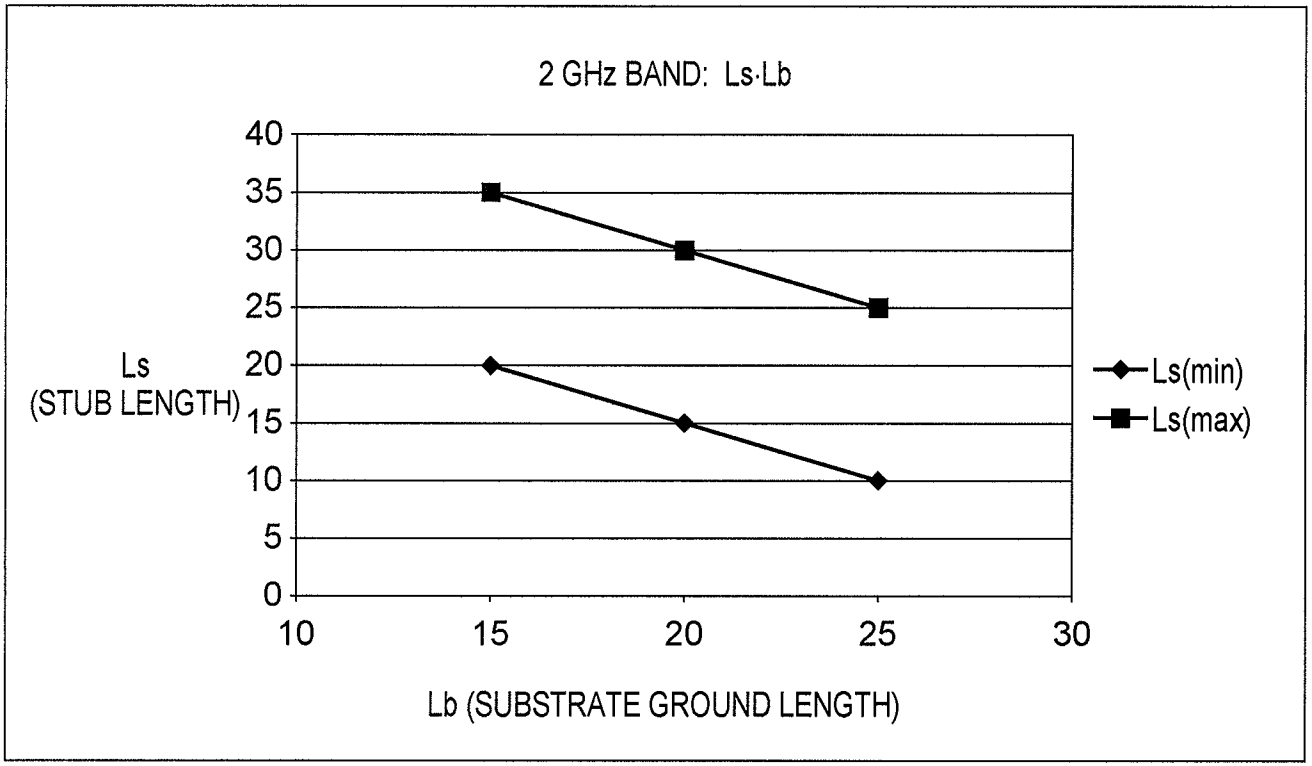
FIG. 7 is a diagram illustrating a relationship between a ground conductor length Lb and an open conductor length Ls for ensuring an antenna input reflectance coefficient VSWR of less than 2.0 in a 2 GHz band.

FIG. 7 is a graph illustrating a relationship between the length Lb of the ground conductor portion 105 and the length Ls of the open conductor portion 106 for fulfilling an antenna input reflectance coefficient VSWR of less than 2.0. The horizontal axis represents the length Lb of the ground conductor portion 105, whereas the vertical axis represents the length Ls of the open conductor portion 106. Here, Ls(min) represents the minimum length of the open conductor portion 106 for the length Lb of the ground conductor portion 105 in order to meet the condition where the VSWR is less than 2.0. On the other hand, Ls(max) represents the maximum length of the open conductor portion 106 for the length Lb of the ground conductor portion 105 in order to meet the condition where the VSWR is less than 2.0. FIG. 7 shows that, for the minimum length Ls(min) required to meet the condition where the VSWR is less than 2.0, the relationship between Lb and Ls is generally a straight line expressed as Ls(min)=−Lb+35 (15<Lb<25). Meanwhile, for the maximum length Ls(max) required to meet the condition where the VSWR is less than 2.0, the relationship is generally a straight line expressed as Ls(max)=−Lb+50 (15<Lb<25). Accordingly, the relationship between Lb and Ls for meeting the condition in which the antenna element 101 reflectance coefficient VSWR is less than 2.0 is, when using a constant K, Ls=−Lb+K, where 35<K<50 (15<Lb<25).

Figure 8B:
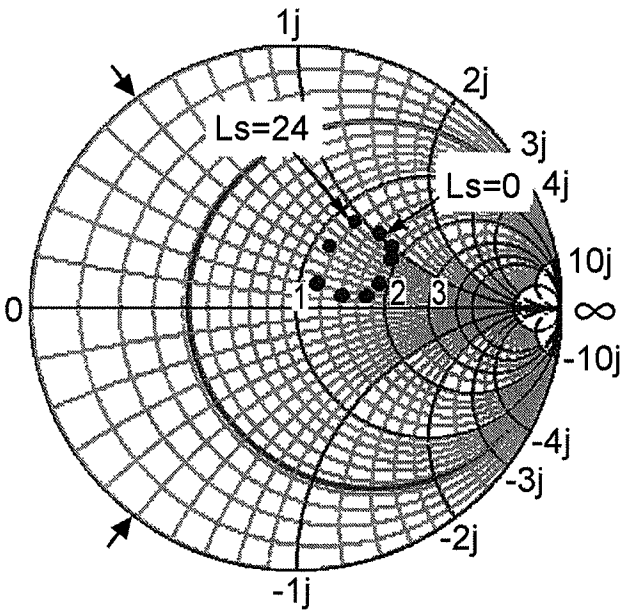
FIGS. 8A and 8B are diagrams illustrating reflection characteristics when a band is 5 GHz, Lb is fixed at 8 mm, and an open conductor length Ls is variable.
Figure 8A:
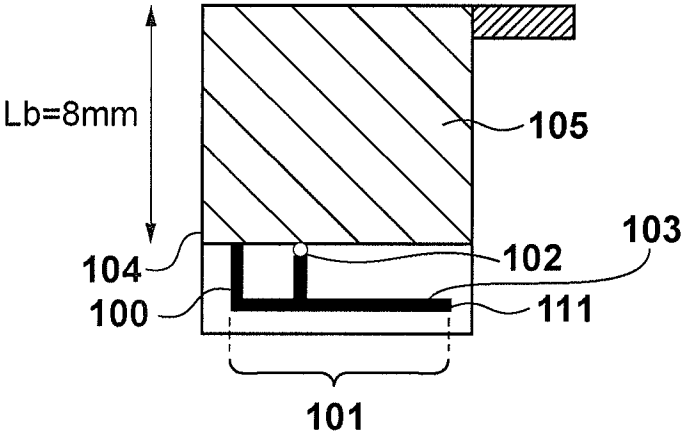

Next, operations carried out when the open conductor portion 106 is attached in a 5 GHz band will be described with reference to FIGS. 8A and 8B. In FIG. 8A, the length Lb of the ground conductor portion 105 on the dielectric substrate 104 is assumed to be 8 mm. FIG. 8B is a Smith chart illustrating the input reflection characteristics of the antenna element 101 when the length Ls of the open conductor portion 106 has been changed in the state illustrated in FIG. 8A. FIG. 8B indicates the values of a reflectance coefficient at various points, assuming that the measurement frequency is the lower frequency of 5.2 GHz in a 5 GHz band for a WLAN. Meanwhile, Table 2 illustrates, in dB units, values expressing the return loss RL of the antenna element 101 when the length Ls of the open conductor portion 106 is changed.

TABLE 2

| Ls | RL(dB) |
|---|---|
| 0 | −9.0 |
| 6 | −7.8 |
| 12 | −8.7 |
| 15 | −12.6 |
| 18 | −16.5 |
| 21 | −9.8 |
| 24 | −9.3 |

The respective points in the Smith chart shown in FIG. 8B are obtained by changing the length Ls at 3 mm intervals from 0 mm to 24 mm, as with the measurement carried out in the 2 GHz band. In the case where the length Lb of the ground conductor portion 105 on the dielectric substrate 104 is 8 mm, and the length Ls of the open conductor portion 106 is 0 mm, or in other words, in the case where the open conductor portion 106 is not attached, there is a large reflectance from the input of the antenna element 101, and it is therefore difficult to ensure conditions where the VSWR is less than 2.0. However, it can be seen that as the length Ls of the open conductor portion 106 is adjusted, the reflection characteristics are improved. Based on Table 2, a reflectance coefficient that fulfills the condition where the VSWR is less than 2.0 can generally be obtained by setting the length Ls of the open conductor portion 106 to the vicinity of 15 mm. In addition, it can be seen that the reflection characteristics will conversely drop if the length Ls of the open conductor portion 106 is set to be greater than or equal to 24 mm.

Figure 9B:
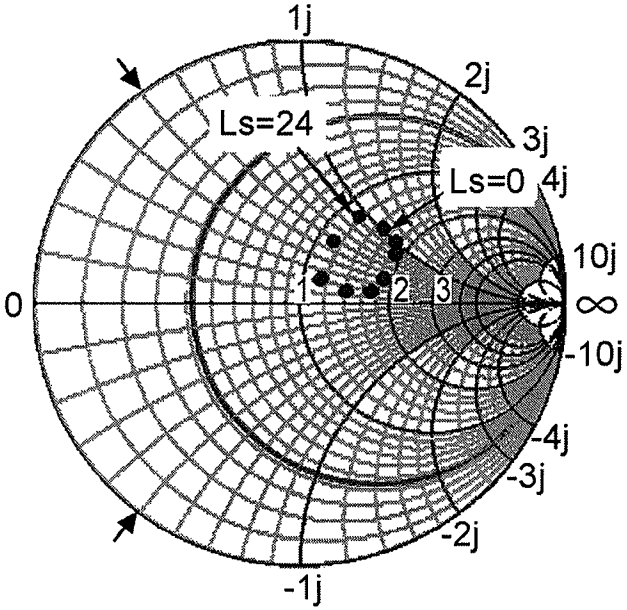
FIGS. 9A and 9B are diagrams illustrating reflection characteristics when a band is 5 GHz, Lb is fixed at 11 mm, and an open conductor length Ls is variable.
Figure 9A:
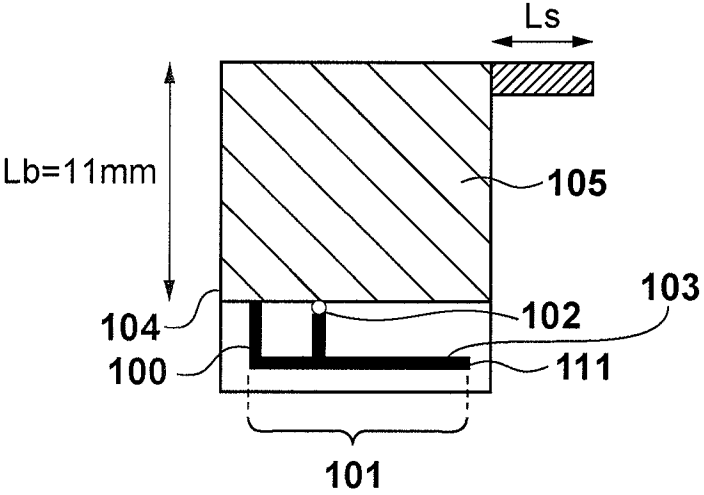

Operations carried out when the open conductor portion 106 is attached to the dielectric substrate 104 will be described with reference to FIGS. 9A and 9B. In FIG. 9A, the length Lb of the ground conductor portion 105 of the dielectric substrate 104 is assumed to be 11 mm. FIG. 9B is a Smith chart illustrating the input reflection characteristics of the antenna element 101 when the length Ls of the open conductor portion 106 has been changed. Meanwhile, Table 3 illustrates, in dB units, values expressing the return loss RL of the antenna element 101 when the length Ls of the open conductor portion 106 is changed.

TABLE 3

| Ls | RL(dB) |
|---|---|
| 0 | −9.1 |
| 6 | −8.9 |
| 12 | −9.6 |
| 15 | −11.3 |
| 18 | −30.0 |
| 21 | −16.5 |
| 24 | −9.3 |

The respective points in the Smith chart shown in FIG. 9B are obtained by changing the length Ls at 3 mm intervals from 0 mm to 24 mm, as with the measurement carried out in the 2 GHz band. As described earlier, the length Lb of the ground conductor portion 105 upon the dielectric substrate 104 is 11 mm. In this case, it can be seen that as opposed to the changes in the reflection characteristics shown in FIG. 8B, the length Lb of the ground conductor portion 105 here has been lengthened by 3 mm, and thus a reflectance coefficient in which the condition where the VSWR is less than 2.0 can be obtained even if the length Ls of the open conductor portion 106 is 12 mm.

Figure 10A:
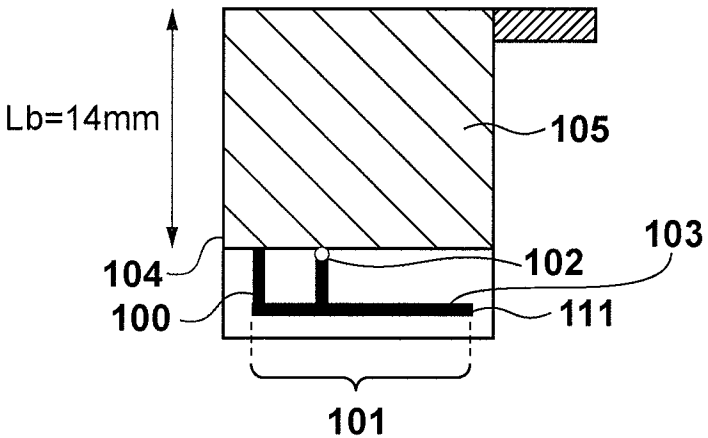
FIGS. 10A and 10B are diagrams illustrating reflection characteristics when a band is 5 GHz, Lb is fixed at 14 mm, and an open conductor length Ls is variable.
Figure 10B:
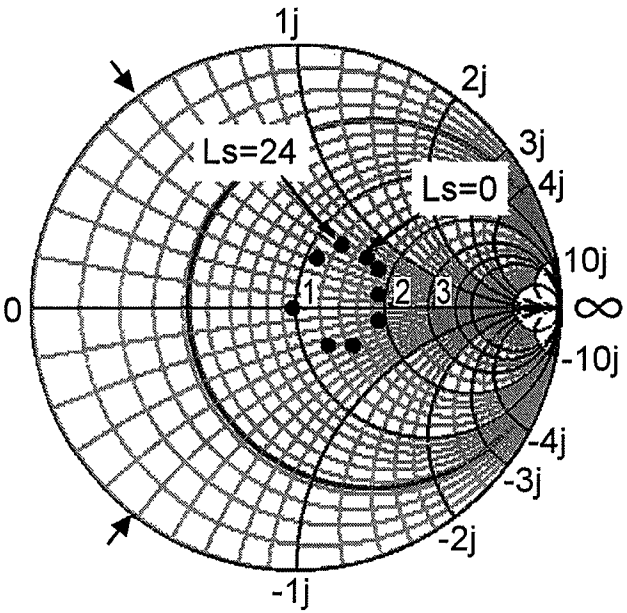

Next, operations carried out when the open conductor portion 106 is attached to the dielectric substrate 104 will be described with reference to FIGS. 10A and 10B. In FIG. 10A, the length Lb of the ground conductor portion 105 on the dielectric substrate 104 is assumed to be 14 mm. FIG. 10B is a Smith chart illustrating the input reflection characteristics of the antenna element 101 when the length Ls of the open conductor portion 106 has been changed. Meanwhile, Table 4 illustrates, in dB units, values expressing the return loss RL of the antenna element 101 when the length Ls of the open conductor portion 106 is changed.

TABLE 4

| Ls | RL(dB) |
|---|---|
| 0 | −8.2 |
| 6 | −8.4 |
| 12 | −15.5 |
| 15 | −17.0 |
| 18 | −11.2 |
| 21 | −9.8 |
| 24 | −8.5 |

The respective points in the Smith chart shown in FIG. 10B are obtained by changing the length Ls at 3 mm intervals from 0 mm to 24 mm, as with the measurement carried out in the 2 GHz band. As described earlier, the length Lb of the ground conductor portion 105 on the dielectric substrate 104 is 14 mm. In this case, it can be seen that as opposed to the changes in the reflection characteristics shown in FIG. 9B, the length Lb of the ground conductor portion 105 here has been lengthened by 3 mm, and thus a reflectance coefficient in which the condition where the VSWR is less than 2.0 can be obtained even if the length Ls of the open conductor portion 106 is 9 mm.

Figure 11B:
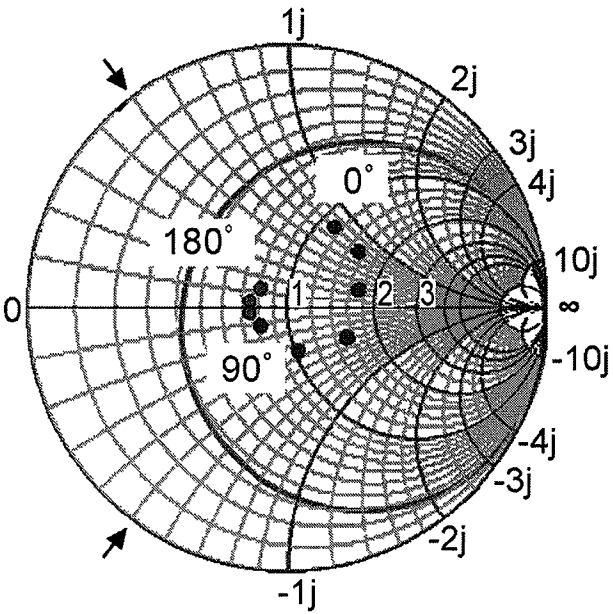
FIGS. 11A and 11B are diagrams illustrating reflection characteristics when a band is 5 GHz and the attachment angle of an open conductor portion to a ground conductor portion is variable.
Figure 11A:
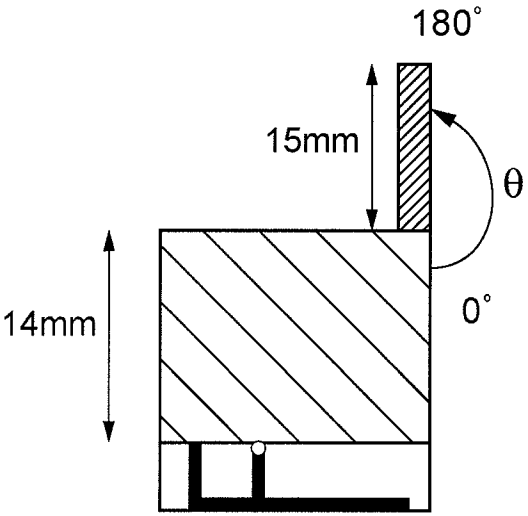

Next, changes in the input reflection characteristics of the antenna element 101 in a 5 GHz band in the case where the attachment angle of the open conductor portion 106 relative to the dielectric substrate 104 has been changed will be described with reference to FIGS. 11A and 11B. In FIG. 11A, the length Lb of the ground conductor portion 105 on the dielectric substrate 104 is assumed to be 14 mm. FIG. 11B is a Smith chart illustrating the input reflectance of the antenna element 101 when an attachment angle of the open conductor portion 106 relative to the side surface of the dielectric substrate 104 has been changed from 0° to 180°, when the length Ls of the open conductor portion 106 is 15 mm. The measurement frequency is a frequency of 5.2 GHz in a 5 GHz band for a WLAN, and FIG. 11B indicates the values of the reflectance coefficient at various points. Meanwhile, Table 5 illustrates values in which the return loss RL of the antenna element 101 at each of the angles θ is expressed in units of dB.

TABLE 5

| θ | RL(dB) |
|---|---|
| 0 | −7.0 |
| 15 | −7.6 |
| 30 | −10 |
| 45 | −14 |
| 60 | −20 |
| 90 | −21 |
| 120 | <−10 |
| 135 | <−10 |
| 180 | <−10 |

In Table 5, it can be seen that when the angle θ is 0°, the open conductor portion 106 overlaps with the ground conductor portion 105, and the state is equivalent to a state in which the open conductor portion 106 is not present. Accordingly, there is a high reflectance from the input of the antenna element 101, resulting in an RL of −7.0 dB; it is thus not possible to ensure conditions in which the VSWR is less than 2.0 (the RL is less than −9.5 dB). However, it can be seen that the reflection characteristics are improved by increasing the angle θ. Based on Table 5, it can be seen that if the range of the angle θ corresponds to 30°<θ<180°, the conditions where the VSWR is less than 2.0 are fulfilled.

Figure 12:
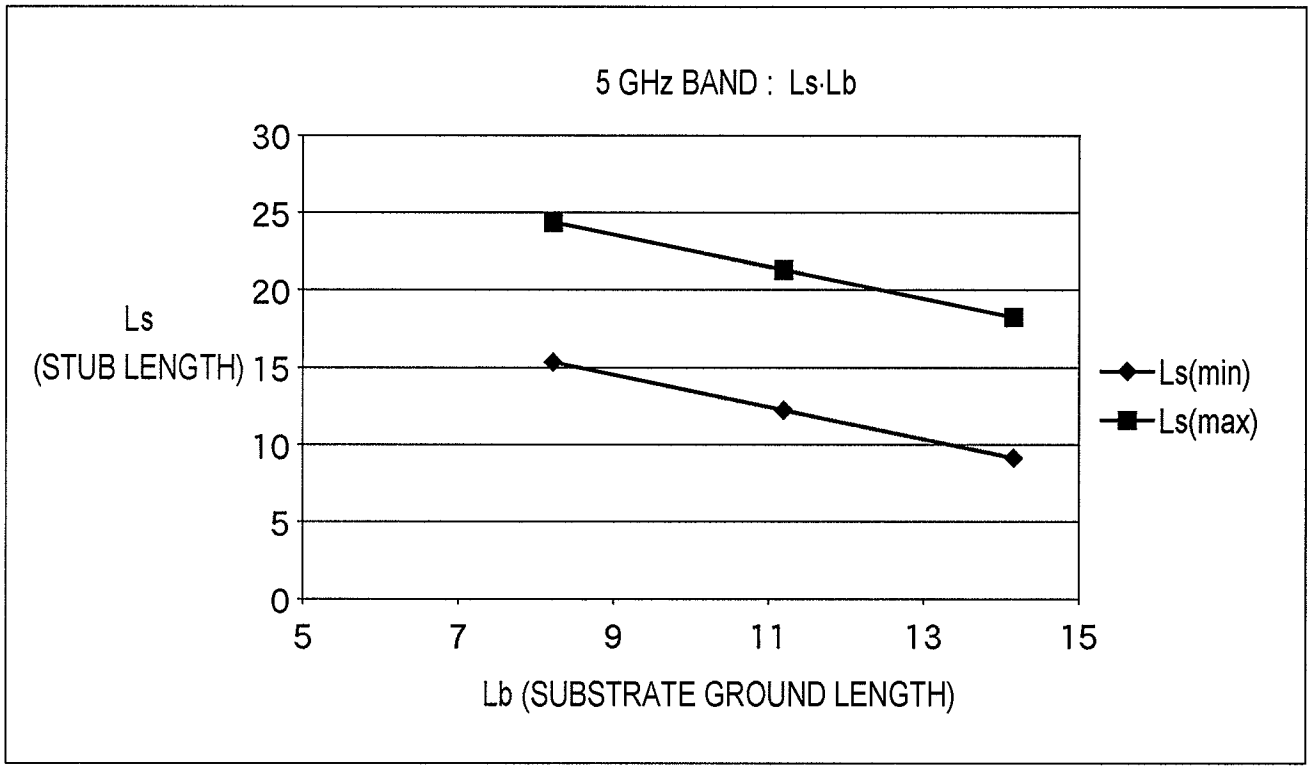
FIG. 12 is a diagram illustrating a relationship between a ground conductor length Lb and an open conductor length Ls for ensuring an antenna input reflectance coefficient VSWR of less than 2.0 in a 5 GHz band.

FIG. 12 is a graph illustrating a relationship between the length Lb of the ground conductor portion 105 and the length Ls of the open conductor portion 106 for fulfilling conditions in which an antenna input reflectance coefficient has a VSWR of less than 2.0. The horizontal axis represents the length Lb of the ground conductor portion 105, whereas the vertical axis represents the length Ls of the open conductor portion 106. Ls(min) represents the minimum length relative to the length Lb of the ground conductor portion 105 in order to meet the condition where the VSWR is less than 2.0. Meanwhile, Ls(max) represents the maximum length relative to the length Lb of the ground conductor portion 105 in order to meet the condition where the VSWR is less than 2.0. The graph in FIG. 12 shows that, for the minimum length Ls(min) required to meet the condition where the VSWR is less than 2.0, the relationship between Lb and Ls is generally a straight line expressed as Ls(min)=−Lb+23(8<Lb<14). Meanwhile, for the maximum length Ls(max) required to meet the condition where the VSWR is less than 2.0, the relationship is generally a straight line expressed as Ls(max)=−Lb+32(8<Lb<14). Accordingly, the relationship between Lb and Ls for meeting the condition in which the antenna element 101 reflectance coefficient has a VSWR of less than 2.0 is, when using a constant L, Ls=−Lb+L, where 23<L<32 (8<Lb<14).

Although the above descriptions discuss the configuration in which the adjustment of the angle θ and the adjustment of the length Ls of the open conductor portion 106 are carried out separately, it should be noted that the condition in which the antenna element 101 reflectance coefficient has a VSWR of less than 2.0 may be fulfilled by adjusting both the angle θ and the length Ls of the open conductor portion 106.

As described thus far, the input reflection characteristics of the antenna element 101 are improved by setting the open conductor 106 to a desired length in accordance with the length of the ground portion 105 in the dielectric substrate 104.

Next, working examples of cases in which the same antenna is used across multiple different devices will be described.

Figure 14:
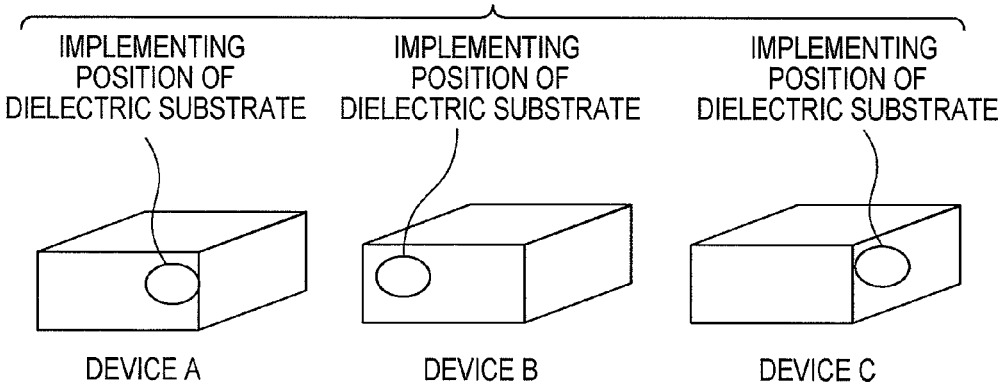
FIG. 14 is a diagram illustrating a wireless unit implemented in multiple different devices.

FIG. 14 illustrates three types of devices, or a device A, a device B, and a device C, in which the same antenna is implemented. It is assumed here that the same antenna element is implemented in implementing positions that differ among the devices A, B, and C.

Figure 15:
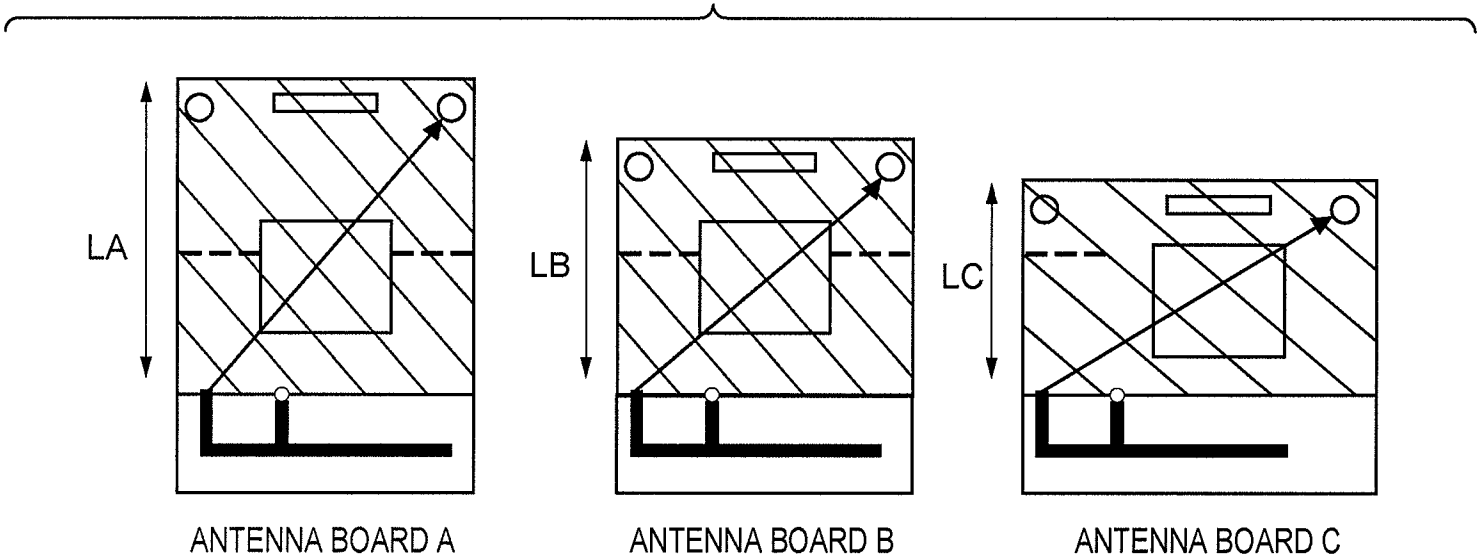
FIG. 15 is a diagram illustrating an example of a case in which the same antenna has been implemented in multiple different devices.

FIG. 15 is a diagram illustrating dielectric substrates A, B, and C, on which the same antenna element is provided, that are to be implemented in the different devices A, B, and C. In FIG. 15, the lengths of the ground portions of the respective dielectric substrates differ, and the lengths of the ground portions of the dielectric substrates A, B, and C are indicated as LA, LB, and LC, respectively. The dielectric substrate A is implemented in the device A, the dielectric substrate B is implemented in the device B, and the dielectric substrate C is implemented in the device C; meanwhile, the dielectric substrate ground lengths LA, LB, and LC are shorter than λ/4 when the wavelength of the center frequency of the usage frequency band is taken as λ.

In the case where the dielectric substrates are implemented in devices as described here, favorable reflection characteristics are not obtained for the antenna elements that are implemented on the respective dielectric substrates. Because the dielectric substrate ground length differs for each device in which the antenna is implemented, it is necessary to change the pattern length of the antenna element for each device, change the matching element for each device, or the like.

In such a case, the reflection characteristics of the antenna element can be improved by adjusting the length of the open conductor, which is a feature of the present invention, on a device-by-device basis, in accordance with the length of the ground portion of the dielectric substrate implemented in the device, as has been described thus far.

Figure 16A:
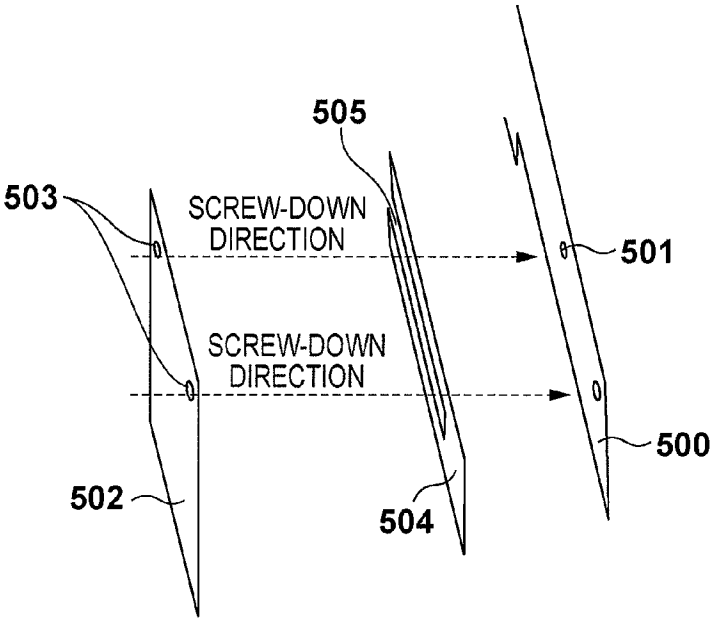
FIGS. 16A and 16B illustrate working examples of the attachment of an open conductor, which is a feature of the present invention, and a dielectric substrate to a device.
Figure 16B:
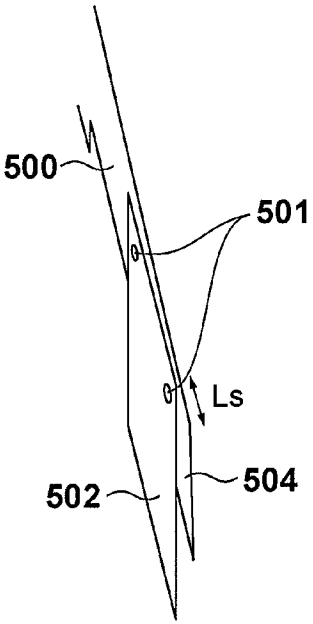

FIGS. 16A and 16B illustrate a working example of the attachment of the open conductor, which is a feature of the present invention, and the dielectric substrate to a device. In FIG. 16A, 500 indicates a metal housing sheet within an electronic device (not shown); the metal housing sheet 500 includes a screw hole 501 to which a dielectric substrate 502 is attached. 504 indicates the open conductor, which is a feature of the present invention; the open conductor 504 includes a slit portion 505, is inserted between the dielectric substrate 502 and the metal housing sheet 500, and is grounded in a high-frequency state when screwed down through the screw hole 501 and the dielectric substrate 502, the open conductor 504, and the metal housing sheet 500 are connected.

FIG. 16B illustrates a state in which the open conductor and the dielectric substrate have been attached to the metal housing sheet. This state of attachment is the same as that illustrated in FIG. 1. The open conductors 106 and 504 are the same members in FIG. 1 and in FIGS. 16A and 16B. Likewise, the metal housing sheet indicated by 108 in FIG. 1 is the same member as the metal housing sheet 500 shown in FIGS. 16A and 16B.

Furthermore, the dielectric substrate 104 shown in FIG. 1 and the dielectric substrate 502 shown in FIGS. 16A and 16B are the same members. In this manner, the open conductor 504, which is a feature of the present invention, has a high-frequency connection by being screwed down between the metal housing sheet 500 of the electronic device itself and the dielectric substrate 502.

Figure 17:
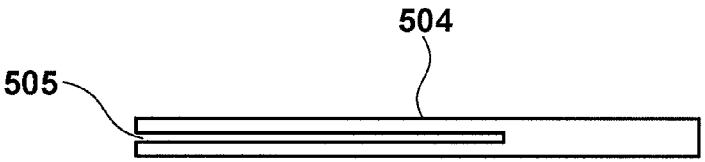
FIG. 17 is a perspective view illustrating the configuration of an open conductor.

FIG. 17 is a diagram illustrating the configuration of the open conductor 504. In FIG. 17, 504 indicates the open conductor, whereas 505 indicates a long-hole or a slit for screwing the open conductor down onto the metal housing sheet 500; the configuration is such that the length Ls by which the open conductor 504 protrudes from the end of the dielectric substrate 502 can be moved and adjusted in the direction of the arrow, as shown in FIG. 16B.

Accordingly, the adjustment of the reflection characteristics of the antenna is carried out by sliding the open conductor that protrudes from the end of the dielectric substrate 502 in the direction of the arrow, thereby changing the length Ls.

As a result, the reflection characteristics are adjusted to the optimal reflection characteristics by changing the length Ls of the open conductor that protrudes from the ground end portion of the dielectric substrate in accordance with the ground length of the dielectric substrate 502 that is implemented in that particular type of device.

As described thus far, according to the present invention, the reflection characteristics of an antenna element can be improved without changing the shape of the antenna element, changing the matching element, and so on, which makes it possible to obtain favorable characteristics in different models of devices using the same antenna. It is therefore extremely easy to manufacture and manage the antenna, which also makes it possible to reduce costs.

(Second Embodiment)

Figure 13:
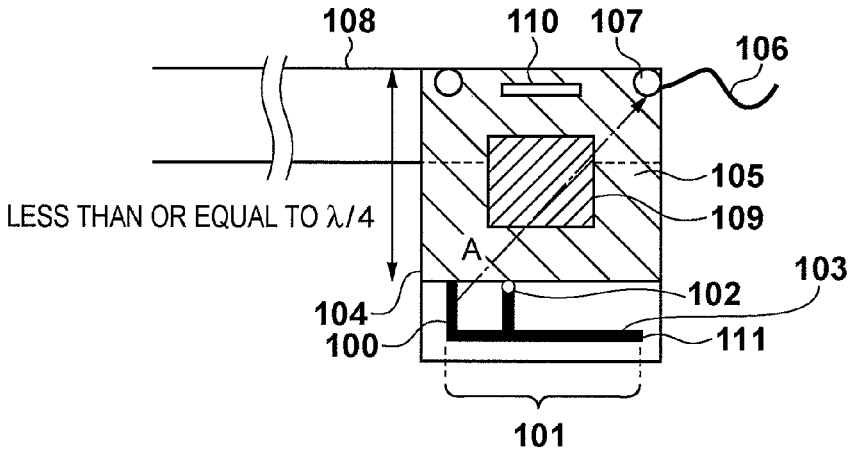
FIG. 13 is a diagram illustrating an open conductor portion 106 of an antenna according to a second embodiment.

FIG. 13 illustrates the basic configuration of an antenna according to a second embodiment. Although the basic configuration of the antenna is the same as that illustrated in FIG. 1, in FIG. 13, the shape of the open conductor portion 106 differs from that described in the first embodiment. The open conductor portion 106 according to the second embodiment is a conductor having a desired length, which is not necessarily a plate-shaped metal sheet. In addition, the configuration may be such that the open conductor is copper foil of a predetermined length that has been coated in a highly-conductive flexible resin.

According to the present invention, it is possible to use the same antenna across different models of electronic devices, while improving the reflection characteristics obtained when the antenna is in an implemented state.

(Other Embodiments)

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable storage medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2010-273018 filed on Dec. 7, 2010 and 2011-219566 filed on Oct. 3, 2011, which are hereby incorporated by reference herein in their entirety.

What is claimed is:

1. An antenna used in wireless communication, comprising:

a dielectric substrate;

a ground conductor portion arranged upon the dielectric substrate;

an antenna element including a radiating conductor portion arranged upon the dielectric substrate opposite to the ground conductor portion, a shorted conductor portion that connects the radiating conductor portion and the ground conductor portion, and a power supply unit adapted to supply a high-frequency current to the radiating conductor portion; and an open conductor portion connected at high frequencies to the ground conductor portion, wherein the open conductor portion is connected to the dielectric substrate so as to protrude by a predetermined length from the location of the ground conductor portion in a diagonal direction from the location where the ground conductor portion and the shorted conductor portion are connected.

2. The antenna according to claim 1, wherein the length by which the open conductor portion protrudes from the ground conductor portion can be adjusted.

3. The antenna according to claim 1, wherein the ground conductor portion has a rectangular shape.

4. The antenna according to claim 3, wherein the location of an end portion is the location of the end portion that is furthest from the location of the connection.

5. The antenna according to claim 1, wherein the location at which the open conductor portion protrudes from the ground conductor portion is the location of an end portion of the ground conductor portion.

6. The antenna according to claim 5, wherein the length of the ground conductor portion in the direction in which the shorted conductor portion faces the ground conductor portion is a length that is shorter than ¼ the wavelength of the operating center frequency of the antenna element.

7. The antenna according to claim 1, wherein the length by which the open conductor portion protrudes from the ground conductor portion is dependent on the length of the ground conductor portion in the direction in which the shorted conductor portion faces the ground conductor portion.

8. The antenna according to claim 1, wherein the radiating conductor portion is arranged parallel to the ground conductor portion.

9. The antenna according to claim 1, wherein the open conductor portion is connected at a predetermined angle relative to the ground conductor portion.

10. An electronic device in which the antenna according to claim 1 is integrated.

11. An adjustment method for an antenna used in wireless communication, the antenna including:

a ground conductor portion arranged upon a dielectric substrate;

an antenna element including a radiating conductor portion arranged upon the dielectric substrate opposite to the ground conductor portion, a shorted conductor portion that connects the radiating conductor portion and the ground conductor portion, and a power supply unit adapted to supply a high-frequency current to the radiating conductor portion; and an open conductor portion connected at high frequencies to the ground conductor portion, and the adjustment method comprising:

adjusting an input reflectance coefficient of the antenna element by changing a predetermined length by which the open conductor portion protrudes from the location of the ground conductor portion in a diagonal direction from the location where the ground conductor portion and the shorted conductor portion are connected in accordance with the length of the ground conductor portion in the direction in which the shorted conductor portion faces the ground conductor portion.

* * * * *